United States Patent [19]

Yassur

[11] Patent Number: 4,792,083

[45] Date of Patent: Dec. 20, 1988

[54] DRINKING TUBES AND COVERS FOR BEVERAGE CONTAINERS AND BEVERAGE CONTAINERS INCORPORATING THE SAME

[76] Inventor: Zion Yassur, Doar Na Shimshon, Moshay Tarom 2, Israel

[21] Appl. No.: 126,704

[22] Filed: Nov. 30, 1987

[51] Int. Cl.[4] ..... B65D 77/28

[52] U.S. Cl. ..... 229/103.1; 215/1 A; 220/90.2

[58] Field of Search ..... 229/103.1; 215/1 A; 239/33; 220/90.2

[56] References Cited

U.S. PATENT DOCUMENTS

| | | | |
|---|---|---|---|
| 2,450,244 | 9/1948 | Lynch | 220/90.2 |
| 3,303,985 | 2/1967 | Prokes et al. | 229/103.1 |
| 3,385,501 | 5/1968 | Chang | 229/103.1 |
| 3,486,679 | 12/1969 | Pfahler | 229/103.1 |
| 4,078,692 | 3/1978 | Stein | 229/103.1 |
| 4,194,674 | 3/1980 | Pearson | 229/103.1 |
| 4,462,503 | 7/1984 | Di Raffaele et al. | 229/103.1 |

FOREIGN PATENT DOCUMENTS

| | | | |
|---|---|---|---|
| 464569 | 4/1950 | Canada | 229/103.1 |

*Primary Examiner*—Stephen Marcus
*Assistant Examiner*—Gary E. Elkins
*Attorney, Agent, or Firm*—W. Thad Adams, III

[57] ABSTRACT

A drinking tube for use in combination with a beverage container of the type having a cover with a sealing tear-out tab which may be pulled to rupture the closure thereof for providing access through the formed opening to the contents of the container. The tube comprises a resilient appendage in the form of a strip attached at one end to the drinking tube at a point intermediate to the ends of the tube. The length of the tube is substantially equal to the diameter of the cover, and the distance from the point of attachment of the strip to one end of the tube is less than the length of the formed opening in the cover. The other end of the strip is attachable to the underside of the cover in a flexed state to resiliently bias end of the tube against the closure.

5 Claims, 1 Drawing Sheet

DRINKING TUBES AND COVERS FOR BEVERAGE CONTAINERS AND BEVERAGE CONTAINERS INCORPORATING THE SAME

The present invention relates to drinking tubes for use in combination with a beverage container.

More particularly the present invention relates to a drinking tube for use in combination with a beverage container of the type having a cover with a sealing tear-out tab which may be pulled to rupture the closure thereof for providing access through the formed opening to the contents of the container and to such a container having a sealed in drinking tube incorporated therein including means whereby removal of said tab results in the automatic protrusion of the built in drinking tube from said opening for the purpose of imbibing contents of said container in a convenient and hygienic manner.

Disposable containers for single-portion beverages, though convenient, economic and popular, suffer from the universal drawback of requiring special means for opening and drinking of the contents thereof. Containers must be torn, pierced or otherwise manipulated, often with the need for special tools such as knives or scissors, and then an appropriate means for drinking must be provided such as a cup or straw. All these methods are substantially similar in that the beverage is or may be contacted with a non-sterile device before consumption of the contents of said container and in the course of preparing to imbibe said contents.

Previous solutions to this problem have proposed the use of "built-in" straws for flexible, deformable bag or box-like containers manufactured from relatively pliable materials. Thus the use of plastic or other water-tight foils enables the incorporation of "tear-off" portions, or of specially designated areas for piercing directly or indirectly by means of a contained, sharp-ended straw. However, these devices are limited to soft, non-carbonated drinks since they can withstand only relatively limited internal-external pressure differences.

U.S. Pat. No. 3,074,612 for instance, describes a container with a tear-off line for reaching a sealed-in straw. The said straw is alligned during manufacture within a specially shaped container to enable correct positioning on opening of the aforesaid container for imbibing of the contents. This invention is essentially not applicable to disposable-type containers in common use, requiring special geometry and special manufacturing techniques.

British Pat. No. 598,612 on the other hand reports a mechanism exhibiting a straw which is partially or wholy excluded from the interior of the container. Again, this invention is not essentially applicable to disposable-type containers in common use.

In U.S. Pat. No. 3,438,527 the prior-art drinking straw is partly exposed and liable to be touched by hand.

It will be noted that none of the above mentioned prior-art devices incorporate any mechanism for automatic protrusion of the straw subsequent to the opening of the container. Instead, the straw must either be manipulated externally, or the act of opening the container in some way reveals or displaces the straw. Such methods are not suitable for use with containers manufactured from substantially more rigid materials since some difficulty will be encountered on trying to locate the internally-placed straw through the walls of the container. Moreover, rigid materials require more drastic means for the opening thereof, said means risking damage to or simultaneous complete withdrawal of, the drinking straw placed, or attached, next to the opening for drinking.

British Pat. No. 789,368, and Israel Pat. Nos. 31518 and 60311 deal with sealed-in straws as part of liquid-containing flexible bags, the pointed end of said straw being employed to pierce the inside of said container for subsequent consumption of the beverage. Apart from problems related to inherent manufacturing difficulties, these methods are totally unsuitable for and inapplicable to rigid or semi-rigid containers.

In U.S. Pat No. 3,303,984 there is described and claimed a paper beverage carton provided with a tubular paper straw therein and accessible through a carton wall opening for drinking by a person through the straw.

In a more recent variation of the above type built-in dispenser straw but adapted for use with a metal or plastic cannister or can, U.S. Pat. No. 4,226,356 describes and claims "a container and dispenser for a liquid held by said container comprising:

a closed container having a circumscribing side wall, a bottom wall connected to said side wall and a top wall secured to the upper end of side wall and serving to seal liquid contents within said container, a drinking straw disposed within said container and having an upper end portion connected to a lower portion by a bendable portion which may be bent without collapsing the wall of said straw, tab means integral with said top wall and removable therefrom, said tab means having at least one longitudinal formation retentively engaging a portion of the length of the upper end of said straw in a manner to permit said straw to be separated from said tab means by a manual pulling force applied between the end of said straw and said tab means, said upper portion of said straw extending in said container at an angle to said lower portion by virtue of the bending of said bendable portion within said container, means for opening said container by pulling said tab means to provide an opening in said top wall, which opening is in line with said straw, wherein said upper portion of said straw is pulled upwardly and passes through said opening and is accessible to the exterior of said container to permit a person holding said container to drink the contents of said container through said straw."

In U.S. Pat. No. 3,547,308 there is described and claimed "in a container, apparatus for drinking contents therefrom and comprising:

a drinking tube normally disposed inside said container;

resilient means connected to said tube and urging it toward the exterior of said container;

retainer means normally retaining said tube in said container; and said tube being normally collapsed inside said container and said resilient device being a spiral spring coaxial with said tube."

In U.S. Pat. No. 3,656,654 there is described and claimed in combination, a beverage container and drinking tube and means to present the tube for use upon opening the container, the combination comprising:

a. an elongate tubular member enclosed within a beverage container having a removable portion in the lid thereof, said tubular member having a length at least equal to an interior diagonal dimension of the container;

b. a positioning member on the removable portion for engaging an upper end portion of said tubular member to guide same through an opening in the lid formed by removing said removable portion;

c. a catch member secured within the container for holding a lower end of said tubular member adjacent a bottom and side of the container;

d. a float member mounted on said tubular member for raising the upper end thereof through the opening in the lid formed by removing said removable portion; and e. means associated with said float member for frictionally engaging the lid of the container adjacent the opening formed therein by removal of said removable portion for holding said tubular member in a drinking position.

Thus it can be seen that with the advent of the cannister or can-like beverage container of the type having a sealing tab which may be pulled to rupture the closure thereof for providing access through the formed opening to the contents of the container, attempts have been made to provide such containers with a sealed-in evacuating straw element whereby upon the opening of said container an end of said straw automatically protrudes through said opening for drinking purposes.

Nevertheless, despite these paper proposals, as embodied in said patents, no commercial product has been marketed based thereon.

In accordance with the present invention there is now provided a drinking tube for use in combination with a beverage container of the type having a cover with a sealing tear-out tab which may be pulled to rupture the closure thereof for providing access through the formed opening to the contents of the container, said tube comprising a resilient appendage in the form of a strip attached at one end thereof to the drinking tube at a point intermediate to the ends of said tube, the length of said tube being substantially equal to the diameter of said cover, and the distance from the point of attachment of said strip to one end of said tube being less than the length of the formed opening in said cover, the other end of said strip being attachable to the underside of said cover in a flexed state to resiliently bias said end of said tube against said closure.

In preferred embodiments of the present invention said strip is integrally formed with said tube and preferably both said tube and said strip are of molded plastic material.

A preferred embodiment of the present invention provides a cover for a beverage container, said cover being of the type having a sealing, tear-out tab which may be pulled to rupture the closure thereof for providing access through the formed opening to the contents of the container, said cover having a drinking tube attached to the underside thereof, said tube comprising a resilient appendage in the form of a strip attached at one end thereof to the drinking tube at a point intermediate to the ends of said tube, the length of said tube being substantially equal to the diameter of said cover, and the distance from the point of attachment of said strip to one end of said tube being less than the length of the formed opening in said cover, the other end of said strip being attachable to the underside of said cover in a flexed state to resiliently bias said end of said tube against said closure.

The invention also is directed to a beverage container of the type having a cover with a sealing tear-out tab which may be pulled to rupture the closure thereof for providing access through the formed opening to the contents of the container, said container comprising a sealed-in drinking tube, said tube comprising a resilient appendage in the form of a strip attached at one end thereof to the drinking tube at a point intermediate to the ends of said tube, the length of said tube being substantially equal to the diameter of said cover, and the distance from the point of attachment of said strip to one end of said tube being less than the length of the formed opening in said cover, the other end of said strip being attached to the underside of said cover in a flexed state, whereby upon the opening of said container the ends of said tube ascribe a rotary movement about the connecting point of said strip to said cover, said end of said tube being rotated to project through said opening for drinking purposes.

Preferably the present invention is provided in a container made of a substantially non-flexible material, such as a can-type container, and the invention is especially preferably embodied in a cannister or can-type beverage container in which the diameter of the container is at least equal to its height.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
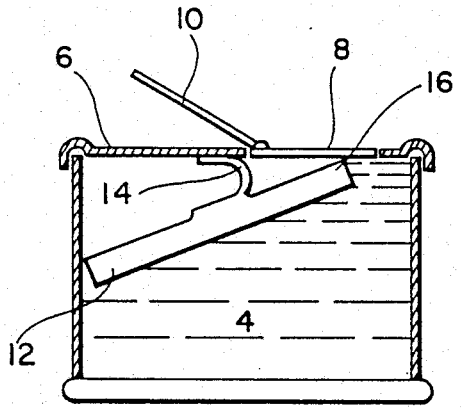
FIG. 1 is a partial cross-sectional view of a beverage container having a cover with a sealing tab and enclosed drinking tube.

In FIG. 1 the present invention is shown in a preferred embodiment represented by a can-type container 2 filled with a beverage 4 and sealed at its upper cover 6 with a sealing tab 8 which may be opened by pulling on ring element 10 to rupture the cover, as is known and used extensively in the beverage industry today. The container comprises a sterile sealed-in drinking tube 12 having an overall length substantially equal to the diameter of the cover 6. The tube 12 is attached to the underside of the cover 6 by means of a resilient strip 14, which strip biases the edge 16 of the tube 14 against sealing tab 8, as seen in the Figure. The distance from the point of attachment of the strip to the edge 16 of the tube is less than the length of the sealing tab 8.

Figure 2:
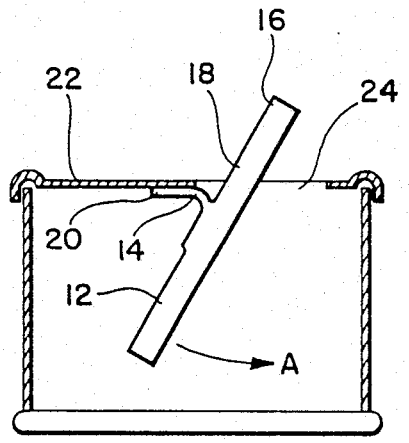
FIG. 2 is a partial view in partial cross-section of the embodiment of FIG. 1, illustrating the position of the drinking tube according to a preferred embodiment of the invention after opening of the container.

Referring now to FIG. 2 it can be seen that once said closure has been ruptured and sealing tab 8 and the attached ring element 10 discarded, thus forming an opening 24, the tube 12 ascribes a rotary movement in the direction of arrow A about the connecting point 20 of said strip 14 to the cover 22. Hence the portion 18 of the tube is rotated to project through the opening 24 for drinking purposes.

Figure 3:
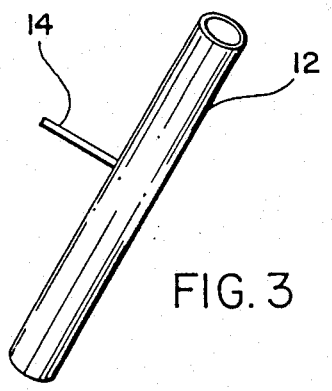
FIG. 3 is a side view of a preferred drinking tube.
Figure 4:
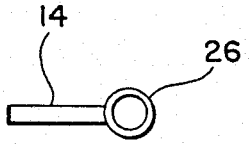
FIG. 4 is a top view of an attaching strip made integral with a ring.

Referring to FIGS. 3 and 4, there is illustrated a preferred embodiment of a drinking tube 12 having an integral connecting strip 14 molded together with the tube as a single unit. Alternatively, the strip 14 may be produced separately together with an integral ring 26 (FIG. 4) or, at least a portion of a ring, which ring is then frictionally slipped over the tube in order to hold the latter at the prescribed distance from one of its edges, as hereinbefore explained. Obviously, the strip with a ring may first be attached to the cover 6 and only thereafter the tube 12 is inserted in the ring.

An essential feature of the present invention is the fact that the means of opening is not necessarily part of the means of protrusion of the drinking straw: the latter is clearly dependent temporarily on the former, but is nonetheless an independently operating mechanism. This feature represents a substantial improvement on previous arrangements since opening of substantially rigid containers requires more force than, for example, piercing of a plastic bag, and there could be a danger of damaging the straw if it is attached to the said disposable tab. Moreover, in rigid containers, especially metal cans, it is important that the disposable tab is, in fact, disposed of, since residual sharp edges could represent a source of danger to the person proposing to imbibe the contents of the said container.

It is another essential advantage of the present invention that a convenient and sterile means of imbibing the contents of a rigid or semi-rigid container is provided which obviates the common practice of drinking with the mouth pressed directly to the opening of the container, a practice which is both unhygienic and potentially dangerous owing to the possible presence of unprotected non-sterile broken edges of the previous seal.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A cover for a beverage container, said cover being of a type having a sealing, tear-out tab which may be pulled to rupture a closure thereof for providing access through a formed opening to the container, said cover having a drinking tube attached to an underside thereof, said tube comprising a resilient appendage in the form of a strip attached at one end thereof to the drinking tube at a point intermediate opposing ends of said tube, said tube having a length substantially equal to a diameter of said cover, and the distance from the point of attachment of said strip to one end of said tube being less than the length of the formed opening in said cover, another end of said strip being attached in an area spaced from said tear-out tab to the underside of said cover in a flexed state to resiliently bias said one end of said tube against said closure.

2. A beverage container of a type having a cover with a sealing tear-out tab which may be pulled to rupture a closure thereof for providing access through a formed opening the container, said container comprising a sealed-in drinking tube, said tube comprising a resilient appendage in the form of a strip attached at one end thereof to the drinking tube at a point intermediate opposing ends of said tube, said tube having a length substantially equal to a diameter of said cover, and the distance from the point of attachment of said strip to one end of said tube being less than the length of the formed opening in said cover, another end of said strip being in an area spaced from said tear-out tab to the underside of said cover in a flexed state, whereby upon the opening of said container the ends of said tube ascribe a rotary movement about the connecting point of said strip to said cover, said one end of said tube being rotated to project through said opening for drinking purposes.

3. A beverage container comprising a sealed-in drinking tube according to claim 2 wherein said container is made of a substantially non-flexible material.

4. A beverage container comprising a sealed-in drinking tube according to claim 2 wherein said container is a can-type container.

5. A beverage container comprising a sealed-in drinking tube according to claim 3 wherein the diameter of said can-type container is at least equal to its height.

* * * * *